US007392587B2

(12) United States Patent
Hasegawa

(10) Patent No.: US 7,392,587 B2
(45) Date of Patent: Jul. 1, 2008

(54) HANDLE FOR SCISSORS

(75) Inventor: Katsumi Hasegawa, Seki (JP)

(73) Assignee: Kai R & D Co., Ltd., Gifu-ken (JP)

( * ) Notice: Subject to any disclaimer, the term of this patent is extended or adjusted under 35 U.S.C. 154(b) by 81 days.

(21) Appl. No.: 10/564,442

(22) PCT Filed: Jul. 13, 2004

(86) PCT No.: PCT/JP2004/009966

§ 371 (c)(1),
(2), (4) Date: Jan. 12, 2006

(87) PCT Pub. No.: WO2005/007353

PCT Pub. Date: Jan. 27, 2005

(65) Prior Publication Data

US 2007/0017104 A1 Jan. 25, 2007

(30) Foreign Application Priority Data

Jul. 18, 2003 (JP) ..... 2003-276562

(51) Int. Cl.
*B26B 13/20* (2006.01)

(52) U.S. Cl. ..... 30/341; 30/232; 30/244; 30/254; 30/343

(58) Field of Classification Search ..... D8/57, D8/107; 30/194, 232, 244, 254, 260, 298, 30/341, 343, 342; 16/430, 431
See application file for complete search history.

(56) References Cited

U.S. PATENT DOCUMENTS

D42,385 S * 4/1912 Alvord et al. ..... D8/57
2,965,967 A * 12/1960 Wahl ..... 30/341
3,840,990 A * 10/1974 Laurenti ..... 30/341
3,951,013 A * 4/1976 Laurenti ..... 76/106.5
4,091,539 A * 5/1978 Watanabe ..... 30/341
5,953,823 A 9/1999 Huang
6,000,138 A * 12/1999 Bornancini ..... 30/232
6,397,478 B1 6/2002 Bornancini (Continued)

FOREIGN PATENT DOCUMENTS

DE 200 06 639 U1 2/2001

(Continued)

OTHER PUBLICATIONS

International Search Report issued Dec. 14, 2004.

(Continued)

*Primary Examiner*—Timothy V Eley
(74) *Attorney, Agent, or Firm*—Posz Law Group, PLC

(57) ABSTRACT

A handle for scissors including an embedded joint portion that is embedded in the finger support of the first handle portion as a joint portion of the first blade and expose from the intermediate section. The first section and the second section extend from the intermediate section to the perceptible portion in the inner end, respectively, with the intermediate section arranged between the first and second sections. The finger support of the first handle portion includes outer cover portions each serving as a finger contact portion. The outer cover portions are formed in the first section in the second section, respectively, for covering the embedded joint portion of the first blade.

14 Claims, 4 Drawing Sheets

U.S. PATENT DOCUMENTS

| | | | | |
|---|---|---|---|---|
| 6,665,939 | B1 * | 12/2003 | Adachi | 30/232 |
| 6,739,057 | B2 * | 5/2004 | Schallenberg | 30/232 |
| 2002/0170181 | A1 | 11/2002 | Schallenberg | |
| 2003/0106222 | A1 | 6/2003 | Huang | |

FOREIGN PATENT DOCUMENTS

| | | |
|---|---|---|
| DE | 200 14 352 U1 | 9/2001 |
| JP | 29-338 | 1/1954 |
| JP | 54-45483 | 9/1977 |
| JP | 578448 | 6/1982 |
| JP | 63-25961 | 2/1988 |
| JP | 11-347263 | 12/1999 |

OTHER PUBLICATIONS

International Preliminary Report on Patentability from PCT issued on May 28, 2006 for the corresponding International patent application No. PCT/JP2004/009966 (a copy and English translation thereof).

European Search Report dated Jan. 28, 2008 in corresponding European Patent Application No. 04747432.5-2313.

* cited by examiner

HANDLE FOR SCISSORS

FIELD OF THE INVENTION

The present invention relates to handles for scissors having finger supports provided in joint portions of the blades.

BACKGROUND OF THE INVENTION

As described in Japanese Laid-Open Utility Model Publication No. 63-25961 and Japanese Registered Design Registration No. 578448, a pair of scissors includes blades that are pivotally joined together at a center portion. Each of the blades has a cutting portion extending distally from the center portion. A handle portion extends proximally from the center portion. Each of the handle portions includes a finger ring secured to a joint portion of the associated blade, which extends from the associated cutting portion. In Japanese Laid-Open Utility Model Publication No. 63-25961, an annular portion of the joint portion of each blade projects outwardly from an inner end of an outer circumference of the finger ring of the associated handle portion. The annular portion is covered at an outer end of the outer circumference of the finger ring. Alternatively, in Japanese Design Registration No. 578448, the annular portion of the joint portion of each blade projects outwardly from the entire outer circumference of the finger ring of the associated handle portion. Typically, the joint portion of each blade is formed of metal and the finger ring of each handle portion is formed of synthetic resin.

For using the scissors described in Japanese Laid-Open Utility Model Publication No. 63-25961, the four fingers (the forefinger, the middle finger, the ring finger, and the pinky finger) other than the thumb are passed through one of the finger rings. The finger ring then faces downward in such a manner that the outer end of the finger ring functions as a support for manipulating the blades while moving the scissors. The outer end of the finger ring thus may be damaged due to wear.

Alternatively, in the scissors of Japanese Industrial Design Registration No. 578448, three fingers (the middle finger, the ring finger, and the pinky finger) but not the forefinger or three fingers (the forefinger, the middle finger, and the ring finger) but not the pinky finger are passed through the corresponding finger ring. In this state, the forefinger or the pinky finger remains outside the finger ring and is thus held in contact with the annular portion of the joint portion of the corresponding blade. This maintains the finger in an uncomfortable state, thus complicating manipulation of the scissors.

Further, generally, for improving cutting performance, a contact point is provided for separating the joint portions of the blades from each other, thereby producing pressing force between the cutting portions of the blades. However, this increases the resistance against manipulation of the blades, thus hampering manipulation of the scissors.

Accordingly, it is an objective of the present invention to prevent a finger support provided in a pair of scissors from being damaged due to wear while maintaining a finger remaining outside the finger support in a comfortable state for facilitating manipulation of the scissors, through improvement of the finger support. It is another objective of the present invention to facilitate the manipulation of the scissors by decreasing the resistance against manipulation of the blades, through improvement of a contact point.

SUMMARY OF THE INVENTION

To achieve the foregoing objectives of the present invention, a first embodiment of the invention provides a pair of scissors having a first blade and a second blade that are pivotally joined together at a center portion. Each of the first and second blades has a cutting portion extending distally from the center portion. A first handle portion and a second handle portion extend proximally from the center portion. The first handle portion and the second handle portion include a joint portion of the first blade and a joint portion of the second blade, respectively, each extending from the associated cutting portion. A finger support having an inner circumferential portion is secured to the joint portion of each blade. In the scissors, an outer circumferential portion of the finger support of at least the first handle portion of the first and second handle portions includes a receptacle portion, an inner end, and an outer end. The receptacle portion receives the joint portion of the first blade. The inner end extends from the receptacle portion over a range in which the finger supports of the first and second handle portions face each other when the first and second blades are held in a closed state. The outer end extends from the inner end to the receptacle portion. Further, the outer end of the finger support of the first handle portion has an intermediate section, a first section, and a second section. An embedded joint portion embedded in the finger support of the first handle portion at the joint portion of the first blade is exposed from the intermediate section. The first and second sections extend from the intermediate section to the receptacle portion and the inner end, respectively, with the intermediate section located between the first and second sections. The finger support of the first handle portion includes an outer cover portion formed in at least one of the first and second sections for covering the embedded joint portion of the first blade. This structure prevents the finger support from being damaged due to wear. Also, the finger outside the finger support is maintained in a comfortable state, and thus manipulation of the scissors is facilitated.

A second embodiment of the present invention provides a pair of scissors having a first blade and a second blade that are pivotally joined together at a center portion. Each of the first and second blades has a cutting portion extending distally from the center portion. A first handle portion and a second handle portion extend proximally from the center portion. The first handle portion and the second handle portion include a joint portion of the first blade and a joint portion of the second blade, respectively, each joint portion extending from the associated cutting portion. A finger support having an inner circumferential portion is secured to the joint portion of each blade. In the scissors, an outer circumferential portion of the finger support of at least the first handle portion of the first and second handle portions includes a receptacle portion, an inner end, and an outer end. The receptacle portion receives the joint portion of the first blade. The inner end extends from the receptacle portion over a range in which the finger supports of the first and second handle portions face each other with the first and second blades held in a closed state. The outer end extends from the inner end to the receptacle portion. Further, an inner end of the joint portion of the first blade, which extends between the receptacle portion of the finger support of the first handle portion and the center portion, and is located adjacent to the inner end of the finger support of the first handle portion, includes a narrowing recess for decreasing width between the inner end of the joint portion of the first blade and an outer end of the joint portion of the first blade located adjacent to the outer end of the finger support of the first handle portion. This reduces the contact area at a contact point between the joint portions of the first and second blades located adjacent to the narrowing recess. Accordingly, resistance against manipulation of the blades becomes relatively small, and thus manipulation of the scissors is facilitated.

BRIEF DESCRIPTION OF THE DRAWINGS

FIG. 3(*b*) is an enlarged cross-sectional view taken along line 3B-3B of FIG. 2;

FIG. 3(*c*) is an enlarged cross-sectional view taken along line 3C-3C of FIG. 2;

FIG. 3(*d*) is an enlarged cross-sectional view taken along line 3D-3D of FIG. 2.

DESCRIPTION OF THE PREFERRED EMBODIMENT

Figure 1:
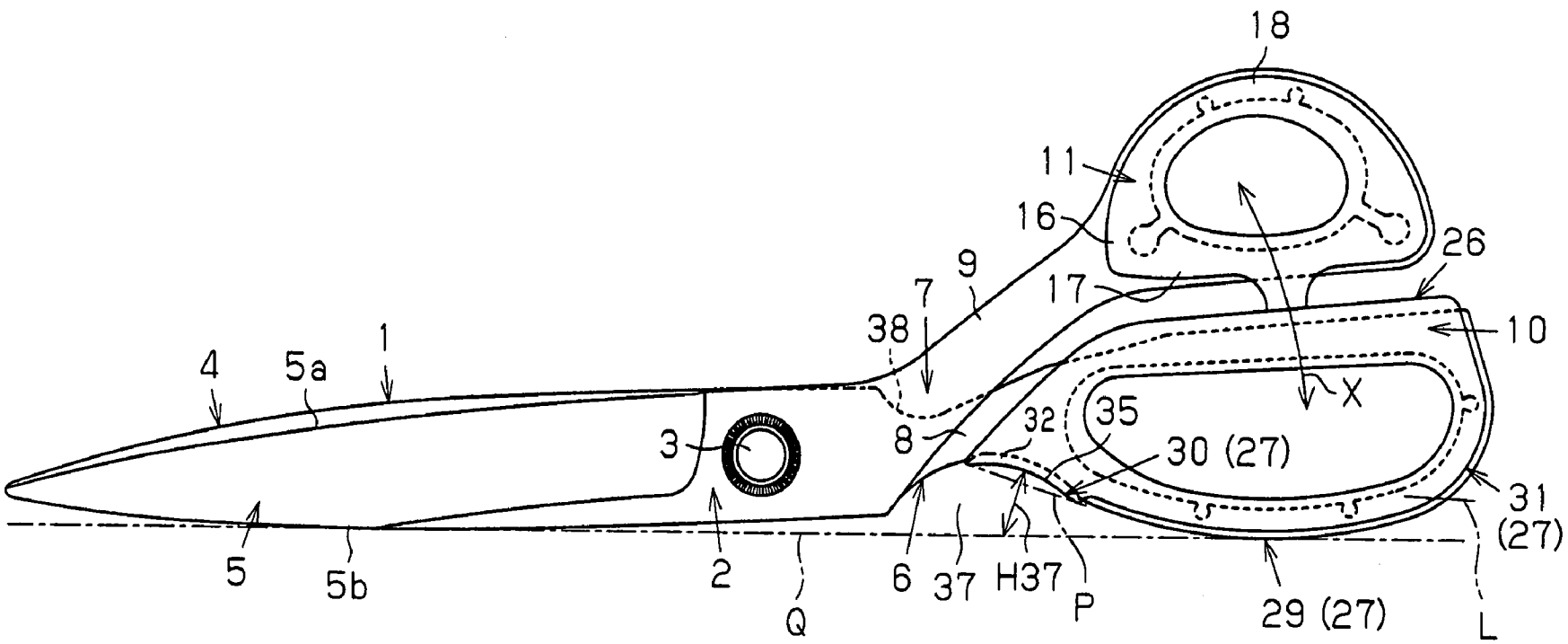
FIG. 1 is a front view showing a pair of scissors according to a first embodiment of the present invention as a whole.
Figure 2:
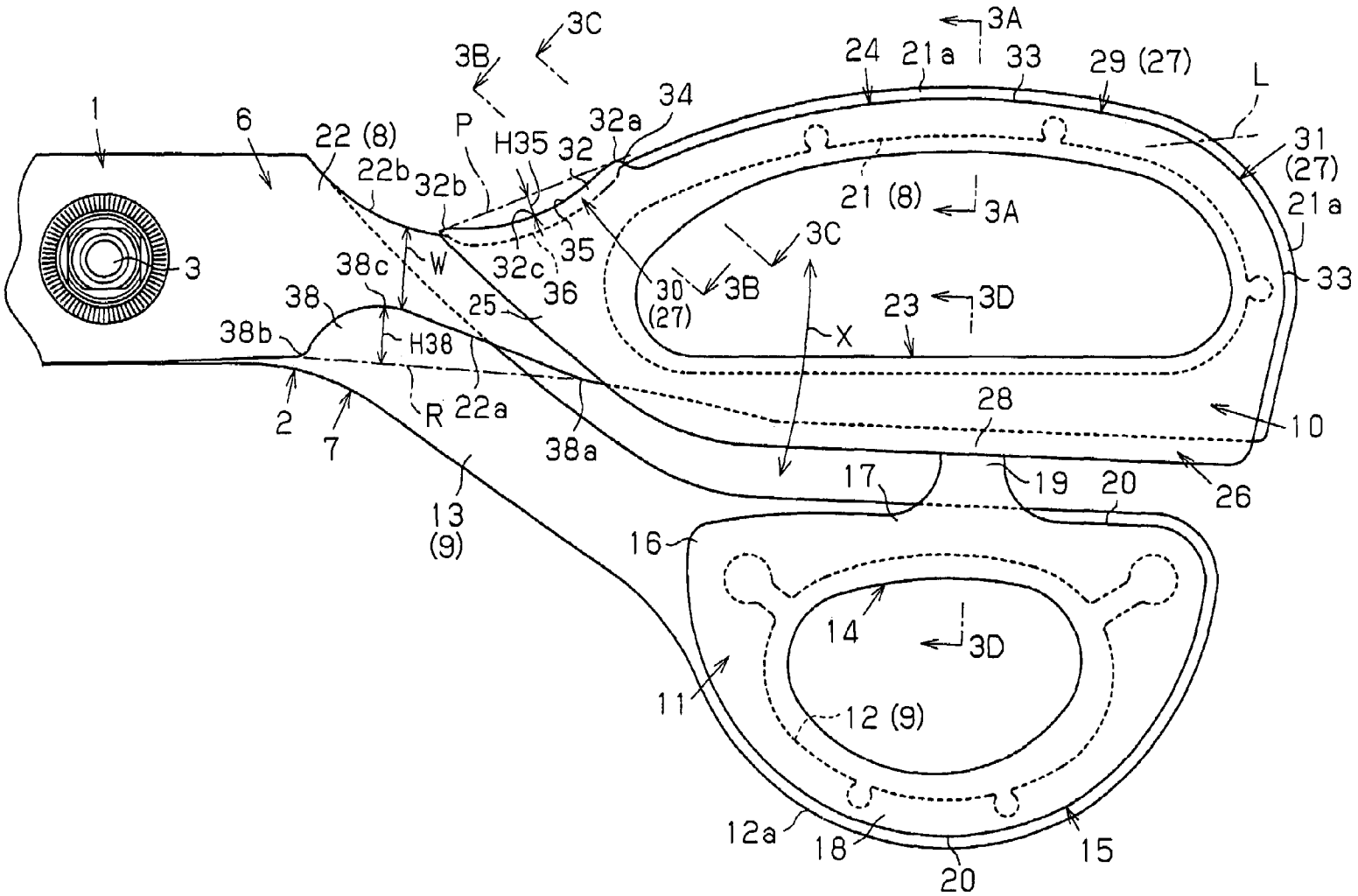
FIG. 2 is a plan view showing a portion of the scissors of the first embodiment, or the handle portions of the scissors.
Figure 3A:
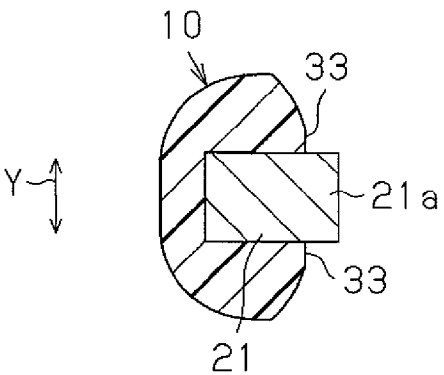
FIG. 3(*a*) is an enlarged cross-sectional view taken along line 3A-3A of FIG. 2.
Figure 3B:
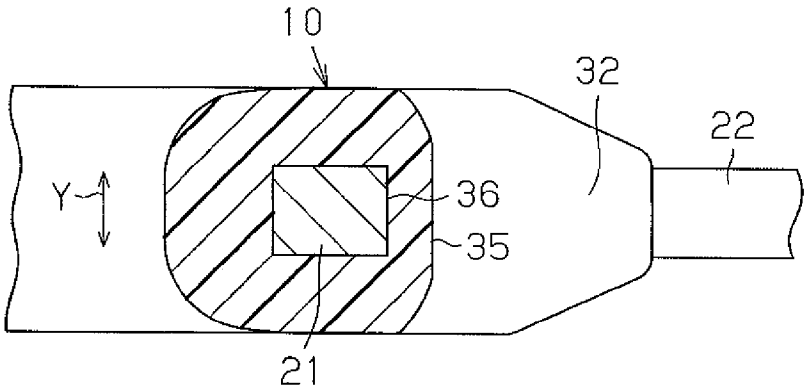
Figure 3C:
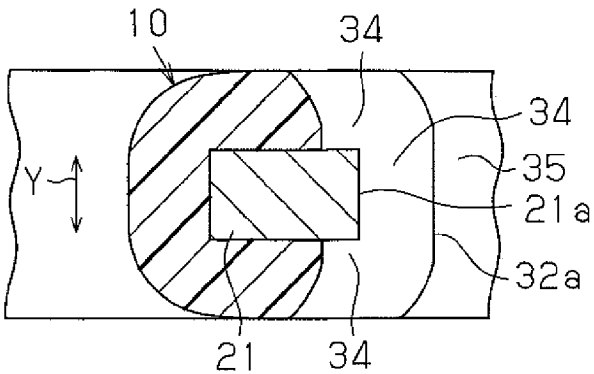
Figure 3D:
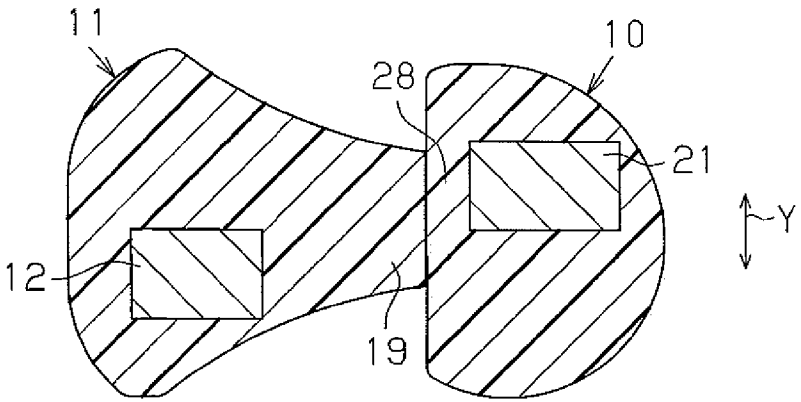

A pair of scissors and handle portions of the scissors according to a first embodiment of the present invention will hereafter be described with reference to FIGS. 1 to 3.

A first blade 1 and a second blade 2 are pivotally joined together at a center portion 3. The first blade 1 and the second blade 2 have a cutting portion 4 and a cutting portion 5, respectively, each of which extends distally from the center portion 3. Likewise, the first blade 1 and the second blade 2 have a first handle portion 6 and a second handle portion 7, respectively, each of which extends proximally from the center portion 3. The first handle portion 6 and the second handle portion 7 include a finger ring (a finger support) 10 and a finger ring (a finger support) 11, respectively. The finger ring 10 and the finger ring 11 are secured to a joint portion 8 of the first blade 1 and a joint portion 9 of the second blade 2, respectively. Each of the joint portions 8, 9 extends from the corresponding one of the cutting portions 4, 5. The first and second blades 1, 2 are formed of metal. The finger rings 10, 11 of the first and second handle portions 6, 7 are formed of synthetic resin. Each of the forefinger, the middle finger, the ring finger, and the pinky finger is entirely or partially passed through the finger ring 10 of the first handle portion 6. The finger ring 10 is thus referred to as a "four-finger ring". The thumb is passed through the finger ring 11 of the second handle portion 7 and thus the finger ring 11 is referred to as a "thumb ring".

Each of the finger rings 10, 11 is secured to the joint portion 8, 9 of the associated one of the first and second blades 1, 2 in such a manner as to form an integral body, by introducing synthetic resin into a cavity defined in a mold (not shown) into which the joint portion 8, 9 has been inserted. The synthetic resin for forming the finger rings 10, 11 may be hard resin such as PP and ABS, soft resin such as silicone, or a mixture of the hard resin and the soft resin. The soft resin may also include elastomer.

In the second handle portion 7, the joint portion 9 of the second blade 2 has an embedded joint ring (an embedded joint portion) 12 and a support arm 13. The embedded joint ring 12 is embedded in the finger ring 11. The support arm 13 extends between the embedded joint ring 12 and the center portion 3. The embedded joint ring 12 is formed in an annular shape in the finger ring 11 of the second handle portion 7. The finger ring 11 of the second handle portion 7 includes an annular, inner circumferential portion 14 and an annular, outer circumferential portion 15. The inner and outer circumferential portions 14, 15 are each arranged in such a manner as to hold opposing sides of the embedded joint ring 12 along a thickness direction Y perpendicular to a plane including a movement direction X of the first and second blades 1, 2. The outer circumferential portion 15 has a receptacle portion 16, an inner end 17, and an outer end 18. The support arm 13 of the joint portion 9 is received in the receptacle portion 16. The inner end 17 extends from the receptacle portion 16 over a range in which the finger rings 10, 11 of the first and second handle portions 6, 7 face each other with the first and second blades 1, 2 held in a closed state. The outer end 18 extends from the inner end 17 to the receptacle portion 16. The finger ring 11 of the second handle portion 7 includes a contact portion (an inner cover portion) 19 projecting from the inner end 17. The contact portion 19 covers a portion of an end of the embedded joint ring 12. That is, the embedded joint ring 12 of the second blade 2 projects in an exposed state from the outer end 18 and the inner end 17 of the finger ring 11 of the second handle portion 7, entirely at the portion other than the portion corresponding to the contact portion 19. The embedded joint ring 12 thus has an exposed end 12*a* forming a step 20 with respect to the outer end 18 and the inner end 17. The inner circumferential portion 14 of the finger ring 11 of the second handle portion 7 as a whole covers the embedded joint ring 12 of the second blade.

In the first handle portion 6, the joint portion 8 of the first blade 1 has an embedded joint ring (an embedded joint portion) 21 and a support arm 22. The embedded joint ring 21 is embedded in the finger ring 10. The support arm 22 extends between the embedded joint ring 21 and the center portion 3. The embedded joint ring 21 is formed in an annular shape in the finger ring 10 of the first handle portion 6. The finger ring 10 of the first handle portion 6 includes an annular, inner circumferential portion 23 and an annular, outer circumferential portion 24. The inner and outer circumferential portions 23, 24 are each arranged in such a manner as to hold opposing sides of the embedded joint ring 21 along the thickness direction Y, which extends perpendicularly to the plane including the movement direction X of the first and second blades 1, 2. The outer circumferential portion 24 has a receptacle portion 25, an inner end 26, and an outer end 27. The support arm 22 of the joint portion 8 is received in the receptacle portion 25. The inner end 26 extends from the receptacle portion 25 over a range in which the finger rings 10, 11 of the first and second handle portion portions 6, 7 face each other with the first and second blades 1, 2 held in a closed state. The outer end 27 extends from the inner end 26 to the receptacle portion 25.

The finger ring 10 of the first handle portion 6 has an inner cover portion 28 extending along the inner end 26 for covering a corresponding end of the embedded joint ring 21 of the first blade 1. The contact portion 19 of the finger ring 11 of the second handle portion 7 contacts the inner cover portion 28 when the first and second blades 1, 2 are held in a closed state.

The outer end 27 of the finger ring 10 of the first handle portion 6 includes an intermediate section 29, a first section 30, and a second section 31. The embedded joint ring 21 of the first blade is exposed from the intermediate section 29. The first section 30 and the second section 31 extend from the intermediate section 29 to the receptacle portion 25 and the inner end 26, respectively. The intermediate section 29 is thus arranged between the first and second sections 30, 31. For illustrative purposes, an arbitrary boundary L is defined between the intermediate section 29 and the second section 31, which extends between the intermediate section 29 and the inner cover portion 28 of the inner end 26. The first section 30 includes an outer cover portion 32 formed in the finger ring 10 of the first handle portion 6, as a finger contact portion. The outer cover portion 32 covers a corresponding end of the embedded joint ring 21 of the first blade 1.

The embedded joint ring 21 of the first blade 1 includes an exposed end 21*a* extending along the intermediate section 29 and the first section. The exposed end 21*a* projects in an exposed state from the outer end 27 and thus forms a step 33 with respect to the outer end 27.

The outer cover portion 32 includes a rear end 32*a* and a front end 32*b*. The front end 32*b* is located adjacent to the exposed end 21*a* of the embedded joint ring 21 of the first blade 1, which is exposed from the intermediate section 29 of the finger ring 10. The rear end 32*a* projects from the exposed end 21*a* and thus forms a step 34 with respect to the exposed end 21*a*. The inner circumferential portion 23 of the finger ring 10 of the first handle portion 6, as a whole, covers the embedded joint ring 21 of the first blade 1.

The finger contact portion, or the outer cover portion 32, has a finger contact surface 35 recessed with respect to a first hypothetical plane P including the rear end 32*a* and the front end 32*b* of the outer cover portion 32. The finger contact surface 35 is defined continuously with the opposing outer surfaces of the finger ring 10. The depth H35 of the finger contact surface 35 with respect to the first hypothetical plane P is maximized at an intermediate section 32*c* between the rear and front ends 32*a*, 32*b*. The finger contact surface 35 is curved between the rear and front ends 32*a*, 32*b* in such a manner that the depth H35 becomes gradually smaller toward the rear or front end 32*a*, 32*b*. The curve of the finger contact surface 35 has one or more centers of curvature outside the first hypothetical plane P. The corresponding radiuses of curvature are each set to 5 millimeters or more so that the curve matches the shape of the corresponding finger pads. The portion of the embedded joint ring 21 of the first blade 1 covered by the outer cover portion 32 has a recessed end 36 that is spaced from the finger contact surface 35 at a certain interval and has a matching shape with the finger contact surface 35.

A finger support recess 37 is recessed with respect to a second hypothetical plane Q including the intermediate section 29 of the finger ring 10 of the first handle portion 6 and a back 5*b* of the cutting portion 5 of the second blade 2, which is opposed to a cutting edge 5*a* of the cutting portion 5. The finger contact surface 35 faces the space defined by the finger support recess 37. The depth H37 of the recessed finger contact surface 35 with respect to the second hypothetical plane Q, as measured along a direction perpendicular to the first hypothetical plane P, is set to five millimeters or more (for example, 7 to 25 millimeters) in correspondence with the size of a corresponding finger.

The support arm 22 of the joint portion 8 of the first blade 1 has an inner end 22*a* located adjacent to the inner end 26 of the finger ring 10 of the first handle portion 6. A narrowing recess 38 is defined in the inner end 22*a* in such a manner as to decrease the width W between the inner end 22*a* and an outer end 22*b*, which is located adjacent to the outer end 27 of the finger ring 10 of the first handle portion 6. The narrowing recess 38 has a substantially curved surface along a direction in which the end 22*a* extends. The depth H38 of the narrowing recess 38 with respect to a third hypothetical plane R including a rear end 38*a* and a front end 38*b* of the narrowing recess 38 is maximized at an intermediate section 38*c* between the rear and front ends 38*a*, 38*b* and becomes gradually smaller toward the rear and front ends 38*a*, 38*b*. A portion of the inner end 22*a* of the narrowing recess 38 in the vicinity of the intermediate section 38*c* has a radius of curvature of five millimeters or more. The support arm 22 of the joint portion 8 of the first blade 1, which is located adjacent to the narrowing recess 38, and the support arm 13 of the joint portion 9 of the second blade 2 define a contact point at which the support arms 13, 22 slide on each other. The contact area of the backside of each of the support arms 13, 22, which defines the contact point, is relatively small.

For using the scissors of the illustrated embodiment, the thumb is passed through the finger ring 11 of the second handle portion 7. In this state, the other four fingers are passed through the finger ring 10 of the first handle portion 6. Alternatively, the three of these fingers (the middle finger, the ring finger, and the pinky finger) other than the forefinger may be passed through the finger ring 10. In this case, the forefinger is held in contact with the finger contact surface 35 of the outer cover portion 32 in the finger support recess 37, outside the finger ring 10. The intermediate section 29 of the outer end 27 of the first handle portion 6 faces downward. In this state, the scissors are moved while manipulating the blades 1, 2, with the exposed end 21*a* of the embedded joint ring 21 of the intermediate section 29 functioning as a support.

Figure 4:
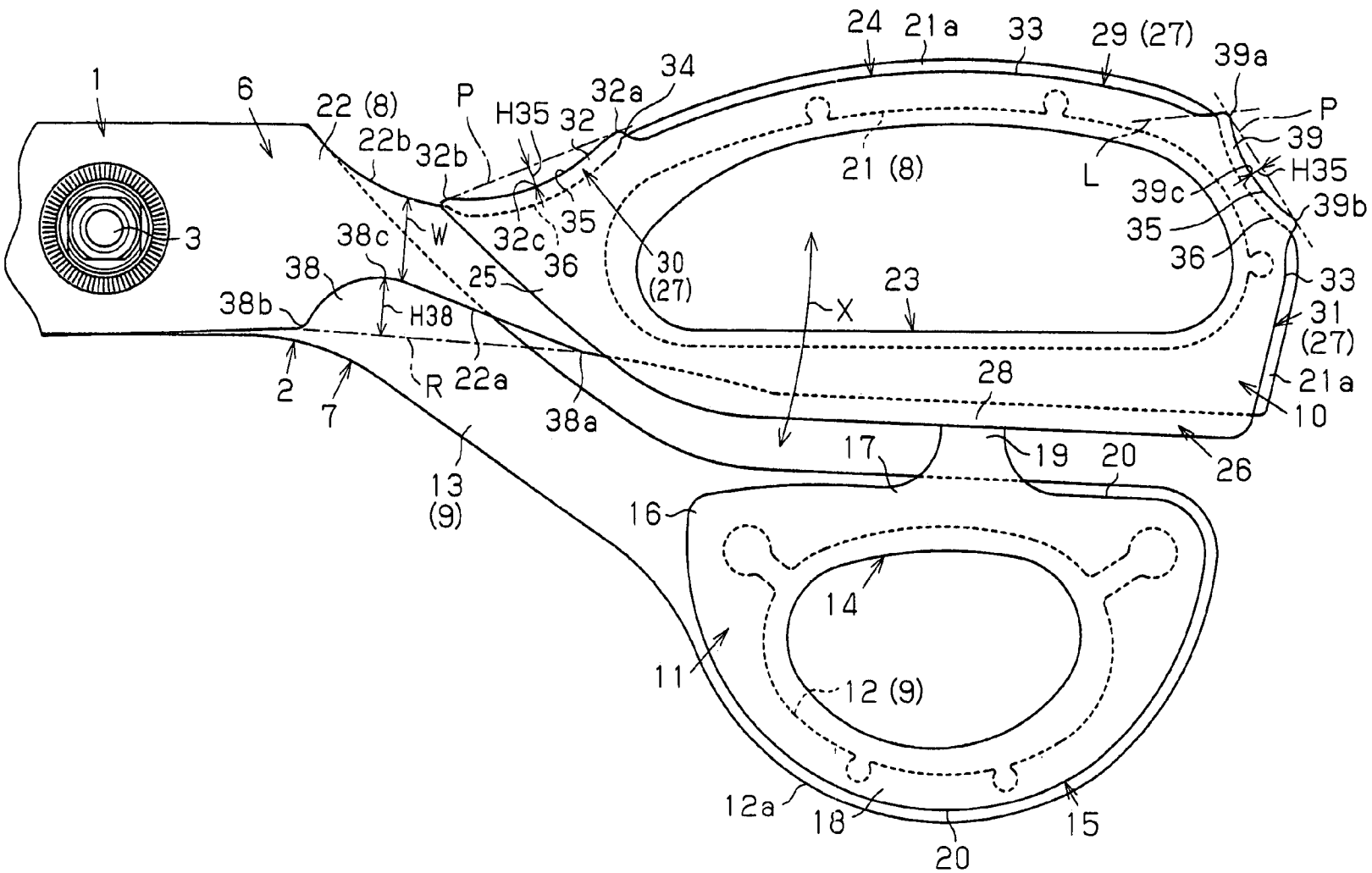
FIG. 4 is a plan view showing a portion of the scissors according to a second embodiment of the present invention, or the handle portions of the scissors.

In a second embodiment of the present invention, as shown in FIG. 4, the finger ring 10 of the first handle portion 6 includes an outer cover portion 39 similar to the outer cover portion 32, as an additional finger contact portion. The outer cover portion 39 is defined in the second section 31 between the intermediate section 29 and the inner cover portion 28 of the inner end 26. The finger support, or the outer cover portion 39, has ends 39*a*, 39*b* that correspond to the ends 32*a*, 32*b*, respectively, an intermediate section 39*c* corresponding to the intermediate section 32*c*, and a finger contact surface 35 corresponding to the finger contact surface 35 of the outer cover portion 32. Three fingers (the forefinger, the middle finger, and the ring finger) but not the pinky finger are passed through the finger ring 10. The pinky finger is held in contact with the outer cover portion 39, outside the finger ring 10.

Each of the support arms 22, 13 of the joint portions 8, 9 of the first and second handle portions 6, 7 may include a synthetic resin cover (not shown) provided on the outer side of the support arm 13, 22. The cover is formed integrally with the associated one of the finger rings 10, 11 and extends from the receptacle portion 25, 16 of the finger ring 10, 11 to the center portion 3. Further, the finger ring 11 of the second handle portion 7 may be configured identically with the finger ring 10 of the first handle portion 6.

(1) As has been described, in the scissors of the illustrated embodiments, the first and second blades 1, 2 are pivotally joined together at the center portion 3. The cutting portions 4, 5 of the first and second blades 1, 2 are provided distally from the center portion 3. The first and second handle portions 6, 7 are arranged proximally from the center portion 3. The joint portions 8, 9 of the first and second blades 1, 2, which extend from the corresponding cutting portions 4, 5, include the finger supports 10, 11. The finger supports 10, 11 have the inner circumferential portions 23, 14. At least in the handle portion 6, not the second handle portion 7, the outer circumferential portion 24 includes the receptacle portion 25, the inner end 26, and the outer end 27. The joint portion 8 of the first blade 1 is received in the receptacle portion 25. The inner end 26 extends from the receptacle portion 25 over a range in which the finger supports 10, 11 of the first and second handle portions 6, 7 face each other with the first and second blades 1, 2 held in a closed state. The outer end 27 extends from the inner end 26 to the receptacle portion 25. Further, the outer end 27 of the finger support 10 of the first handle portion 6 has the intermediate section 29 and the first and second sections 30, 31. The embedded joint portion 21 of the joint portion 8 of the first blade 1, which is embedded in the finger support 10 of the first handle portion 6, is exposed from the intermediate section 29. The first and second sections 30, 31 extend from the intermediate section 29 to the receptacle portion 25 and the inner end 26, respectively, with the intermediate section 29 located between the first and second sections 30, 31. At least one of the first and second sections 30, 31 has the outer cover portion 32, 39 formed in the finger support 10 for covering the embedded joint portion 21 of the first blade 1. Further, although the finger supports 10, 11 of the first and second handle portions 6, 7 have the completely annular shapes, each of the finger supports 10, 11 may be partially disconnected so that the inner circumferential portion 23, 14 and the outer circumferential portion 24, 15 are continuous.

For using the scissors, the corresponding fingers are passed through the finger supports 10, 11 of the first and second handle portions 6, 7. If necessary, any of the fingers may be held in contact with the outer cover portion 32, 39 of the first or second section 30, 31 of the finger support 10, outside the finger support 10. With the embedded joint portion 21 of the first blade 1, which is exposed from the intermediate section 29 of the finger support 10, functioning as a support, the scissors are moved while manipulating the first and second blades 1, 2. It is thus unnecessary to use the finger support 10 as the support for moving the scissors and manipulating the blades 1, 2. This prevents the finger support 10 from being damaged due to wear. Further, in this case, the finger held in contact with the outer cover portion 32, 39 does not interfere with the embedded joint portion 21 of the first blade 1. The finger is thus maintained in a comfortable state. This facilitates manipulation of the scissors.

(2) The finger support 10 of the first handle portion 6 has the inner cover portion 28 provided in the inner end 26 in such a manner as to cover the embedded joint portion 21 of the first blade 1. The contact portion 19, which is formed in the finger support 11 of the second handle portion 7, contacts the inner cover portion 28 when the first and second blades 1, 2 are closed. That is, the finger supports 10, 11 of the first and second handle portions 6, 7 contact each other when the first and second blades 1, 2 are closed. This prevents unpleasant noise from being generated by contact between the joint portions 8, 9 of the first and second blades 1, 2.

(3) The embedded joint portion 21 of the first blade 1 is exposed from the portions of the outer and inner ends 27, 26 of the finger support 10 of the first handle portion 6 other than the portions corresponding to the outer cover portions 30, 31 and the inner cover portion 28. That is, the embedded joint portion 21 is exposed from the finger support 10 of the first handle portion 6 except for the portions corresponding to the outer cover portions 30, 31 and the inner cover portion 28, which are provided at positions at which the embedded joint portion 21 must be covered. This configuration suppresses interference between the outer end 27 of the finger support 10 and an object, thus preventing the finger support 10 from being damaged due to wear.

(4) The outer circumferential portion 15 of the finger support 11 of the second handle portion 7 has the receptacle portion 16, the inner end 17, and the outer end 18. The receptacle portion 16 receives the joint portion 9 of the second blade 2. The inner end 17 extends from the receptacle portion 16 over a range in which the finger supports 10, 11 of the first and second handle portions 6, 7 face each other with the first and second blades 1, 2 held in a closed state. The outer end 18 extends from the inner end 17 to the receptacle portion 16. Further, the finger support 11 of the second handle portion 7 has the inner cover portion 19 formed in the inner end 17, serving as a contact portion of the finger support 11 of the second handle portion 7. The inner cover portion 19 covers the embedded joint portion 12 of the joint portion 9 of the second blade 2, which is embedded in the finger support 11 of the second handle portion 7. The embedded joint portion 12 of the second blade 2 is exposed from the portions of the outer and inner ends 18, 17 of the finger support 11 of the second handle portion 7 other than the portion corresponding to the inner cover portion 19, or the contact portion. That is, the embedded joint portion 12 is exposed from the finger support 11 of the second handle portion 7 except for the portion corresponding to the inner cover portion 19 provided at a position at which the embedded joint portion 12 must be covered. This configuration suppresses interference between the outer end 18 of the finger support 11 and an object, thus preventing the finger support 11 from being damaged due to wear.

(5) Each of the embedded joint portions 21, 12 extends along the outer circumference of the finger support 10, 11 of the associated one of the first and second handle portions 6, 7. In each of the finger supports 10, 11 of the first and second handle portions 6, 7, the inner circumferential portions 23, 14 and the outer circumferential portions 24, 15 are arranged in such a manner as to hold the opposing sides of the corresponding embedded joint portion 21, 12 in the thickness direction Y perpendicular to the plane including the movement direction X of the first and second blades 1, 2. This arrangement allows the user of the scissors to comfortably hold the finger supports 10, 11 of the first and second handle portions 6, 7.

(6) The embedded joint portion 21 of the first blade 1, which is exposed from the outer end 27 of the finger support 10 of the first handle portion 6, includes the exposed end 21*a* projecting from the outer end 27 for forming the step 33 with respect to the outer end 27. The exposed end 21*a* of the embedded joint portion 21 thus easily interferes with an object, thus preventing such interference between the outer end 27 of the finger support 10 and the object. The finger support 10 is thus prevented from being damaged due to wear.

(7) Each of the outer cover portions 32, 39 has the opposing ends 32*a*, 32*b* or 39*a*, 39*b*. The ends 32*a*, 39*a* are each exposed from the exposed end 21*a* and form the steps 34 with respect to the exposed end 21*a*. When the blades 1, 2 are manipulated with the corresponding fingers held in contact with the outer cover portions 32, 39 of the finger support 10 outside the finger support 10, interference between the fingers and the embedded joint portion 21 of the first blade 1 does not occur easily. This reliably maintains contact between the fingers and the outer cover portions 32, 39 of the finger support 10. The fingers outside the finger support 10 are thus held in a comfortable state.

(8) The outer cover portions 32, 39 of the finger support 10 of the first handle portion 6 are shaped in such a manner as to define finger contact portions.

(9) In the finger support 10 of the first handle portion 6, each of the contact portions 32, 39 has the finger contact surface 35 recessed with respect to the first hypothetical plane P including the opposing ends 32*a*, 32*b* or 39*a*, 39*b* of the contact portion 32, 39. For example, the finger contact surface 35 is formed continuously with the corresponding opposing outer sides of the finger support 10. This structure makes it easy for the finger to be held in contact with the outer cover portion 32 or 39, outside the finger support 10.

(10) The depth H35 of each finger contact surface 35 with respect to the first hypothetical plane P, which includes the opposing ends 32*a*, 32*b* or 39*a*, 39*b* of the associated finger contact portion 32, 39, is maximized at the intermediate section 32*c*, 39*c* of the finger contact portion 32, 39, which is located between the opposing ends 32*a*, 32*b* or 39*a*, 39*b*. The finger contact surface 35 is partially or entirely curved in such a manner that the depth H35 becomes gradually smaller from the intermediate section 32*c*, 39*c* toward the opposing ends 32*a*, 32*b* or 39*a*, 39*b* of the finger contact portion 32. The fingers held in contact with the finger contact portions 32, 39 are thus maintained in a comfortable state, outside the finger support 10.

(11) At each of the sections covered by the finger contact portions 32, 39, the embedded joint portion 21 of the first blade 1 has the recessed end 36 spaced from the corresponding finger contact surface 35 at a certain interval and recessed in a manner matching the shape of the finger contact surface 35. The finger contact portions 32, 39 are thus supported by the corresponding recessed ends 36, when the fingers are held in contact with the finger contact portions 32, 39 outside the finger support 10. This prevents the finger contact portions 32, 39 from deforming, thus maintaining the fingers in a comfortable state.

(12) In the finger support 10 of the first handle portion 6, the outer cover portion 32, or the finger contact portion, is provided in the first section 30 extending between the intermediate section 29 and the receptacle portion 25. With the first and second blades 1, 2 held in a closed state, the finger contact portion 32 faces the space defined by the finger support recess 37, which is recessed with respect to the second hypothetical plane Q including the intermediate section 29 and the back 5*b* of the cutting portion 5 of the second blade 2.

(13) The depth H37 of the finger contact portion 32 with respect to the second hypothetical plane Q, as measured perpendicularly to the first hypothetical plane P including the ends 32*a*, 32*b* of the finger contact portion 32, is set to five millimeters or more. As has been described, manipulation of the scissors is performed by moving the scissors while opening or closing the first and second blades 1, 2 with the corresponding fingers held in contact with the finger contact portions 32, 39 outside the finger support 10, and with the embedded joint portion 21 exposed from the intermediate section 29 of the finger support 10 functioning as the support. In such manipulation, the above-described setting of the depth H37 allows the finger support recess 37 to receive the corresponding finger and prevents the finger from interfering with an object, thus maintaining the finger comfortably. Particularly, if the corresponding portion of the finger is received in the finger support recess 37 as a whole, including the pad, the back, and the nail, interference between the finger and an object is further effectively suppressed when the scissors are manipulated.

(14) In the scissors of the illustrated embodiments, the first and second blades 1, 2 are pivotally joined together at the center portion 3. The first blade 1 and the second blade 2 have the cutting portion 4 and the cutting portion 5, respectively, which portions 4, 5 extend distally from the center portion 3. The first handle portion 6 and the second handle portion 7, extending proximally from the center portion 3, include the joint portion 8 of the first blade 1 and the joint portion 9 of the second blade 2, respectively, which joint portions 8, 9 extend from the associated cutting portions 4, 5. Each of the finger supports 10, 11 is secured to the corresponding one of the joint portions 8, 9 and has the inner circumferential portion 23, 14. At least in the first handle portion 6, not the second handle portion 7, the outer circumferential portion 24 includes the receptacle portion 25, the inner end 26, and the outer end 27. The joint portion 8 of the first blade 1 is received in the receptacle portion 25. The inner end 26 extends from the receptacle portion 25 over a range in which the finger supports 10, 11 of the first and second handle portions 6, 7 face each other with the first and second blades 1, 2 held in a closed state. The outer end 27 extends from the inner end 26 to the receptacle portion 25. The joint portion 8 of the first blade 1, which extends between the receptacle portion 25 of the finger support 10 of the first handle portion and the center portion 3, has the inner end 22*a*. The inner end 22*a* is located adjacent to the inner end 26 of the finger support 10 of the first handle portion 6. The narrowing recess 38 is defined in the inner end 22*a* for reducing the width W between the inner end 22*a* and the outer end 22*b*, which is located adjacent to the outer end 27 of the finger support 10 of the first handle portion 6. This correspondingly decreases the contact area at the contact point between the joint portions 8, 9 of the first and second blades 1, 2, which are located adjacent to the narrowing recess 38. Accordingly, the resistance against manipulation of the blades 1, 2 becomes relatively small, thus facilitating manipulation of the scissors.

(15) In the joint portion 8 of the first blade 1, the depth H38 of the narrowing recess 38 with respect to the third hypothetical plane R including the opposing ends 38*a*, 38*b* of the narrowing recess 38 is maximized at the intermediate section 38*c* between the ends 38*a*, 38*b*. The narrowing recess 38 is partially or entirely curved in such a manner that the depth H38 becomes gradually smaller from the intermediate section 38*c* toward the ends 38*a*, 38*b* of the narrowing recess 38. This structure makes it easy to grind the portion corresponding to the narrowing recess 38.

(16) The finger support 10, 11 of each of the first and second handle portions 6, 7 is formed of resin, thus maintaining the fingers holding the finger supports 10, 11 in a comfortable state.

What is claimed is:

1. A handle for a pair of scissors having a first blade and a second blade that are pivotally joined together at a center portion, each of the first and second blades having a cutting portion extending distally from the center portion, a first handle portion and a second handle portion extending proximally from the center portion, the first handle portion and the second handle portion including a joint portion of the first blade and a joint portion of the second blade, respectively, each extending from the associated cutting portion, the handle comprising: a finger support having an inner circumferential portion respectively being securable to the joint portion of each blade, wherein an outer circumferential portion of the finger support of at least the first handle portion of the first and second handle portions includes a receptacle portion, an inner end, and an outer end, the receptacle portion receiving the joint portion of the first blade, the inner end extending from the receptacle portion over a range in which the finger support of the first and second handle portions respectively face each other when the first and second blades are held in a closed state, the outer end extending from the inner end to the receptacle portion, wherein the outer end of the finger support of the first handle portion has an intermediate section, a first section, a second section, and an embedded joint portion embedded in the finger support of the first handle portion of the first blade being exposed from the intermediate section; the first and second sections extending from the intermediate section to the receptacle portion and the inner end, respectively, with the intermediate section located between the first and second sections, the finger support of the first handle portion including an outer cover portion formed in at least one of the first and second sections for covering the embedded joint portion of the first blade, wherein the outer cover portion of the first support of the first handle portion is shaped as a finger contact portion, and wherein the finger contact portion has a finger contact surface recessed with respect to a first hypothetical plane including opposing ends of the finger contact portion.

2. The scissors handle according to claim 1, wherein the inner end of the finger support of the first handle portion includes an inner cover portion with which a contact portion formed in the finger support of the second handle portion is held in contact when the first and second blades are held in a closed state, the inner cover portion covering the embedded joint portion of the first blade.

3. The scissors handle according to claim 2, wherein the embedded joint portion of the first blade is exposed from the portions of the outer and inner ends of the finger support of the first handle portion except for the portions corresponding to the outer cover portion and the inner cover portion.

4. The scissors handle according to claim 2, wherein the outer circumferential portion of the finger support of the second handle portion includes a receptacle portion, an inner end, and an outer end, the receptacle portion receiving the joint portion of the second blade, the inner end extending from the receptacle portion over a range in which the finger support of the first and second handle portions respectively face each other when the first and second blades are held in a closed state, the outer end extending from the inner end to the receptacle portion, wherein the finger support of the second handle portion includes an inner cover portion formed at the inner end as the contact portion of the finger support of the second handle portion, the inner cover portion covering an embedded joint portion embedded in the finger support of the second handle portion at the joint portion of the second blade, and wherein the embedded joint portion of the second blade is exposed from the portions of the outer and inner ends of the finger support of the second handle portion except for the portion corresponding to the inner cover portion serving as the contact portion.

5. The scissors handle according to claim 1, wherein each of the embedded joint portions extends along the outer circumference of the finger support of the corresponding one of the first and second handle portions, the finger supports of the first and second handle portions being provided in such a manner as to cover and hold the corresponding embedded joint portions.

6. The scissors handle according to claim 1, wherein the embedded joint portion of the first blade exposed from the outer end of the finger support of the first handle portion includes an exposed end, the exposed end projecting from the outer end for forming a step with respect to the outer end.

7. The scissors handle according to claim 6, wherein an end of the outer cover portion located adjacent to a portion of the exposed end of the embedded joint portion of the first blade exposed from the intermediate section of the finger support of the first handle portion projects from the exposed end and forms a step with respect to the exposed end.

8. The scissors handle according to claim 1, wherein the finger contact surface is curved in such a manner that a depth of the finger contact surface is maximized at an intermediate section between the opposing ends of the finger contact portion and becomes smaller from the intermediate section toward the ends of the finger contact portion.

9. The scissors handle according to claim 1, wherein a portion of the embedded joint portion of the first blade covered by the finger contact portion includes a recessed end spaced from the finger contact surface.

10. The scissors handle according to claim 1, wherein the outer cover portion of the finger support of the first handle portion serving as the finger contact portion is arranged in the first section extending between the intermediate section and the receptacle portion, not in the second section, wherein the finger contact portion faces a finger support recess that is recessed with respect to a second hypothetical plane including the intermediate section of the outer end of the finger support of the first handle portion and a back of the cutting portion of the second blade when the first and second blades are held in a closed state.

11. The scissors handle according to claim 10, wherein a depth of the finger contact surface with respect to the second hypothetical plane along a direction perpendicular to the first hypothetical plane including the opposing ends of the finger contact portion is set to five millimeters or more.

12. The scissors handle according to claim 1, wherein an inner end of the joint portion of the first blade, which extends between the receptacle portion of the finger support of the first handle portion and the center portion, and is located adjacent to the inner end of the finger support of the first handle portion, includes a narrowing recess for decreasing a width between the inner end of the joint portion of the first blade and an outer end of the joint portion of the first blade located adjacent to the outer end of the finger support of the first handle portion, whereby reducing the contact area at a contact point between the joint portions of the first and second blades located adjacent to the narrowing recess.

13. The scissors handle according to claim 12, wherein the narrowing recess is curved in such a manner that a depth of the narrowing recess with respect to another hypothetical plane including opposing ends of the narrowing recess is maximized at an intermediate section between the ends of the narrowing recess and becomes smaller from the intermediate section to the ends of the narrowing recess.

14. The scissors handle according to claim 1, wherein the finger support of each of the first and second handle portions is formed of resin.

* * * * *

UNITED STATES PATENT AND TRADEMARK OFFICE

CERTIFICATE OF CORRECTION

PATENT NO. : 7,392,587 B2
APPLICATION NO. : 10/564442
DATED : July 1, 2008
INVENTOR(S) : Hasegawa It is certified that error appears in the above-identified patent and that said Letters Patent is hereby corrected as shown below:

Title Page, Item (73) Assignee: should read as follows:

--(73) Assignee: KAI R&D CENTER CO., LTD., Gifu-ken, Japan--.

Signed and Sealed this

Twenty-sixth Day of January, 2010

David J. Kappos

David J. Kappos
*Director of the United States Patent and Trademark Office*